US008542177B2

(12) United States Patent
Lee

(10) Patent No.: US 8,542,177 B2
(45) Date of Patent: Sep. 24, 2013

(54) DATA DRIVING APPARATUS AND DISPLAY DEVICE COMPRISING THE SAME

(75) Inventor: Whee-won Lee, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 560 days.

(21) Appl. No.: 12/472,902

(22) Filed: May 27, 2009

(65) Prior Publication Data

US 2010/0090992 A1 Apr. 15, 2010

(30) Foreign Application Priority Data

Oct. 14, 2008 (KR) ..... 10-2008-0100749

(51) Int. Cl.
*G09G 3/36* (2006.01)

(52) U.S. Cl.
USPC ..... 345/99

(58) Field of Classification Search
USPC ..... 345/99, 204
See application file for complete search history.

(56) References Cited

U.S. PATENT DOCUMENTS

| | | | | |
|---|---|---|---|---|
| 6,734,840 | B2 * | 5/2004 | Fukutoku et al. | 345/96 |
| 7,227,522 | B2 * | 6/2007 | Fujimoto et al. | 345/87 |
| 2002/0163591 | A1 * | 11/2002 | Tsutsui | 348/571 |
| 2006/0050305 | A1 * | 3/2006 | Tokuyama | 358/1.15 |
| 2007/0159440 | A1 * | 7/2007 | Kang | 345/99 |
| 2008/0129675 | A1 * | 6/2008 | Tanaka | 345/99 |

* cited by examiner

*Primary Examiner* — Chanh Nguyen
*Assistant Examiner* — Tsegaye Seyoum
(74) *Attorney, Agent, or Firm* — F. Chau & Associates, LLC

(57) ABSTRACT

A data driving apparatus includes a horizontal synchronization start signal generation circuit and data driving circuit. The horizontal synchronization start signal generation circuit generates a horizontal synchronization start signal using image data signals. The data driving circuit samples the image data signals in response to the horizontal synchronization start signal and supplies a plurality of data signals using the sampled image data signals in response to a load signal. The horizontal synchronization start signal generation circuit is disabled in response to the load signal.

20 Claims, 8 Drawing Sheets

DATA DRIVING APPARATUS AND DISPLAY DEVICE COMPRISING THE SAME

CROSS-REFERENCE TO RELATED APPLICATION

This application claims priority to Korean Patent Application No. 10-2008-0100749, filed on Oct. 14, 2008 in the Korean Intellectual Property Office, the disclosure of which is incorporated by reference in its entirety herein.

BACKGROUND OF THE INVENTION

1. Technical Field of the Invention

The present disclosure relates to a data driving apparatus and a display device comprising the same.

2. Discussion of Related Art

A liquid crystal display (LCD) includes a color filter substrate including a reference electrode and color filters, a thin film transistor (TFT) substrate including switching elements and a pixel electrode, and a liquid crystal layer interposed between the two substrates. Different electric fields are applied to the pixel electrode and the reference electrode to change the arrangement of liquid crystal molecules and control the transmittance of light, thereby displaying an image.

A data driver of the LCD samples image data signals supplied from a timing controller in response to a horizontal synchronization start signal, and applies data signals to data lines using the sampled image data signals.

However, when the horizontal synchronization start signal is generated from the data driver using the image data signals supplied from the timing controller rather than a separate line, noise due to data control signals may cause the data driver to malfunction, resulting in deterioration of display quality of the LCD.

Thus, there is a need for a data driving apparatus that is less susceptible to noise and a display apparatus that includes the data driving apparatus.

SUMMARY OF THE INVENTION

According to an exemplary embodiment of the present invention, a data driving apparatus includes a horizontal synchronization start signal generation circuit and a data driving circuit. The horizontal synchronization start signal generation circuit generates a horizontal synchronization start signal using image data signals. The data driving circuit samples the image data signals in response to the horizontal synchronization start signal and supplies a plurality of data signals using the sampled image data signals in response to a load signal. The horizontal synchronization start signal generation circuit is disabled in response to the load signal.

According to another exemplary embodiment of the present invention, a data driving apparatus includes a horizontal synchronization start signal generation circuit and a data driving circuit. The horizontal synchronization start signal generation circuit generates a horizontal synchronization start signal using image data signals. The horizontal synchronization start signal generation circuit includes a plurality of flip-flops, an operation unit, a shift register, a digital-to-analog converter, and a buffer. The flip-flops are connected to one another in a cascade manner. The flip-flops are supplied with and sequentially output the image data signals. The operation unit performs an operation on output signals supplied from at least two flip-flops among the plurality of flip-flops. The shift register samples the image data signals in response to the horizontal synchronization start signal and a data sampling clock signal, and outputs the sampled image data signals in response to the load signal. The digital-to-analog converter receives the sampled image data signals from the shift register and outputs a plurality of analog data signals corresponding to the sampled data signals. The buffer is supplied with the plurality of analog data signals, selects polarities of the analog data signals and provides the selected polarities to the data signals. The horizontal synchronization start signal generation circuit is disabled in response to the load signal.

Another exemplary embodiment of the present invention includes a display device including a display panel that includes a plurality of unit pixels at intersections of a plurality of gate lines and a plurality of data lines, a timing controller that provides data control signals and image data signals, and a data driver that applies data signals to the plurality of data lines in response to the data control signals and the image data signal. The data driver includes a horizontal synchronization start signal generation circuit and a data driving circuit. The horizontal synchronization start signal generation circuit generates a horizontal synchronization start signal using image data signals. The data driving circuit samples the image data signals in response to the horizontal synchronization start signal and supplies a plurality of data signals using the sampled image data signals in response to a load signal. The horizontal synchronization start signal generation circuit is disabled in response to the load signal.

BRIEF DESCRIPTION OF THE DRAWINGS

The present invention will become more apparent by describing in detail exemplary embodiments thereof with reference to the attached drawings in which.

DETAILED DESCRIPTION OF EXEMPLARY EMBODIMENTS

Figure 1:
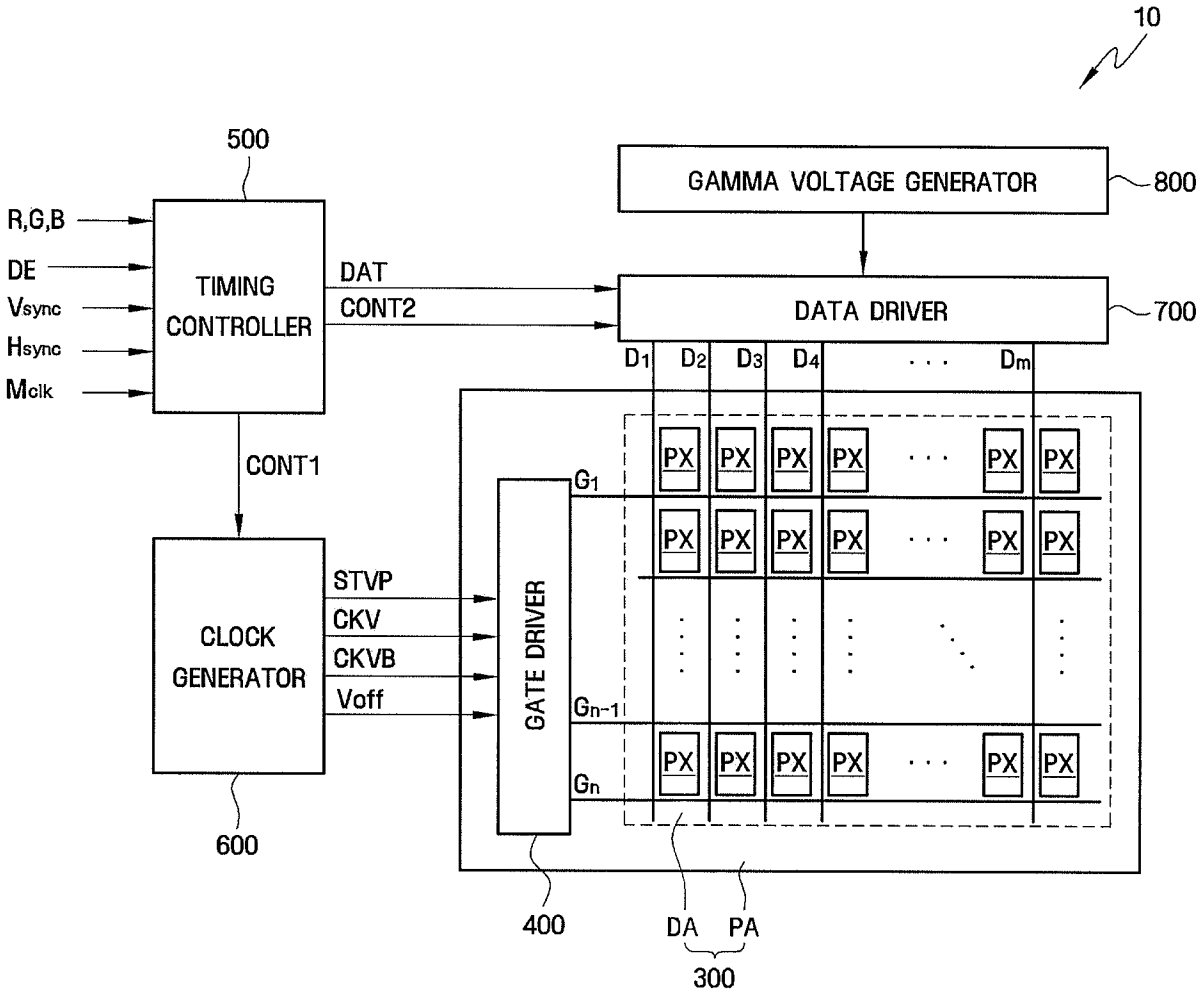
FIG. 1 is a block diagram of a liquid crystal display according to an exemplary embodiment of the present invention.

The present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Like reference numerals refer to like elements throughout the specification. Hereinafter, exemplary embodiments of the present invention will be described with reference to the accompanying drawings.

Figure 2:
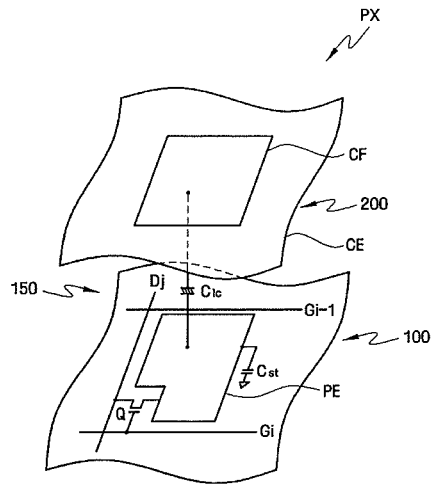
FIG. 2 is an equivalent circuit diagram of a unit pixel shown in FIG. 1.
Figure 3:
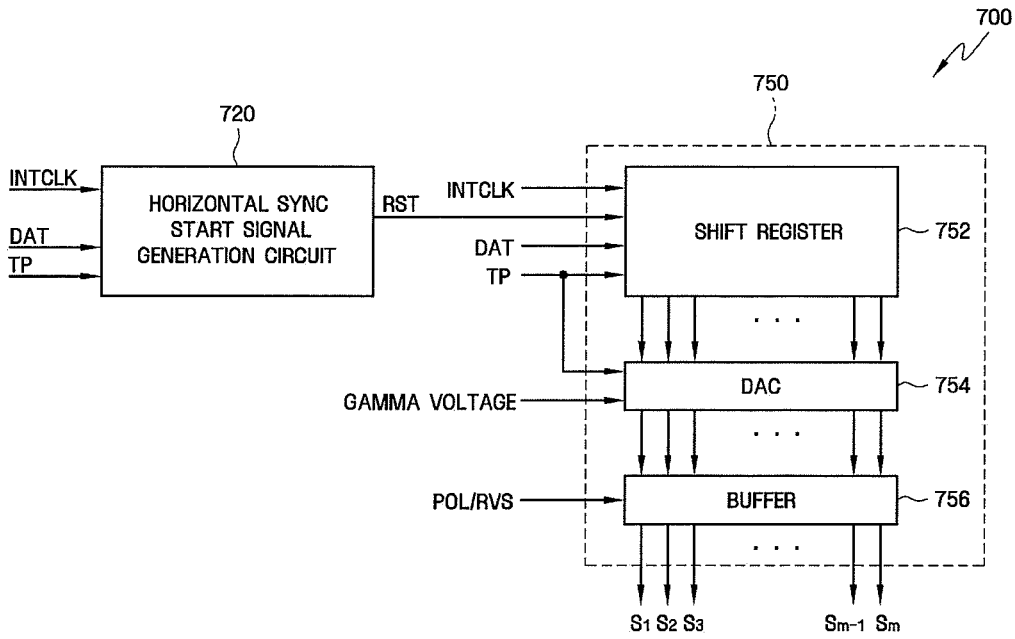
FIG. 3 is a diagram showing a data driver according to an exemplary embodiment of the present invention.

FIG. 1 is a block diagram of an exemplary embodiment of a liquid crystal display according to the present invention. FIG. 2 is an equivalent circuit diagram of a unit pixel shown in FIG. 1. FIG. 3 is a diagram showing a data driver according to an exemplary embodiment of the present invention.

Referring to FIG. 1, a liquid crystal display 10 according to an exemplary embodiment of present invention includes a liquid crystal panel 300, a timing controller 500, a clock generator 600, a gate driver 400, a data driver 700, and a gamma voltage generator 800.

Referring to FIG. 2, one pixel PX of the liquid crystal display of FIG. 1 will now be described. A color filter CF may be formed on a portion of a common electrode CE of the second substrate 200 such that the color filter CF faces the pixel electrode PE of the first substrate 100. For example, the pixel PX, which is connected to an i-th (where i=1 to n) gate line Gi and a j-th (where j=1 to m) data line Dj, includes the switching element Q, which is connected to the signal lines Gi and Dj, and a liquid crystal capacitor Clc and a storage capacitor Cst, which are connected to the switching element Q. In alternative exemplary embodiments, the storage capacitor Cst may be omitted. The switching element Q is a thin film transistor ("TFT"), which may be formed of amorphous-silicon ("a-Si"), for example.

The timing controller 500 receives input image signals R, G and B from an external graphic controller (not shown) and input control signals which control display of the input image signals R, G and B. The input control signals may include a vertical synchronization signal Vsync, a horizontal synchronization signal Hsync, a main clock signal Mclk and a data enable signal DE, for example, but are not limited thereto. The timing controller 500 generates a gate control signal CONT2 on the basis of the input image signals R, G and B and the input control signals and provides the gate control signal CONT2 and image data signals DAT to the data driver 700. The timing controller 500 may also provide the clock generator 600 with a gate control signal CONT1 containing an output enable signal OE, a clock generation control signal CPV, a original scan start signal STVP. The gate control signal CONT may include additional signals.

The clock generator 600 may generate a clock signal CKV, a clock bar signal CKVB, and a scan start signal STVP using the output enable signal OE, the clock generation control signal CPV, the original scan start signal STVP, and any additional signals included in the gate control signal CONT, and provide the same to the gate driver 400. The clock bar signal CKVB may have a phase opposite to that of the clock generation control signal CPV.

The gate driver 400 receives the clock generation control signal CPV, the clock bar signal CKVB, the scan start signal STVP, and a gate-off voltage Voff, and sequentially applies gate signals to gate lines G1-Gn.

As illustrated in FIG. 1, the gate driver 400 is formed on a non-display area PA of the display panel 300 to be connected to the display panel 300. However, the gate driver 400 may be formed elsewhere on the display panel 300. In an alternative exemplary embodiment, the gate driver 400 is provided as a gate driving integrated circuit ("IC") in the form of a tape carrier package ("TCP"). As illustrated in FIG. 1, the gate driver 400 is disposed at one side of the display panel 300. However, the gate driver 400 is not limited to being disposed at any particular side of the display panel 300. For example, in a display device according to another exemplary embodiment of the present invention, a gate driver includes first and second gate drivers disposed at both sides of the display panel 300.

The gamma voltage generator 800 generates two sets of multiple gamma voltages associated with transmittance of a unit pixel and supplies the data driver 700 with the generated gamma voltages. A first set of the multiple gamma voltages may be positive data voltages and a second set of the multiple gamma voltages may be negative data voltages. The positive data voltages and the negative data voltages may have opposite phases in polarity to each other with respect to a common voltage Vcom. The polarity of a data voltage with respect to the common voltage Vcom will be referred to as 'data voltage polarity' hereinafter.

The data driver 700 receives image data signals DAT and a data control signal CONT2, and supplies data signals S1-Sm corresponding to the image data signals DAT to the data lines D1-Dm. The data driver 700 includes a horizontal synchronization start signal generation circuit 720 and a data driving circuit 750. The data control signal CONT2 may include a load signal TP for enabling data signals to be generated using the sampled image data signals DAT, a polarity signal POL or an inversion signal RVS for inverting a data voltage polarity and a data clock signal HCLK used to generate a data sampling clock signal INTCLK. The data driver 700 may be provided as a data driving integrated circuit ("IC") in the form of a tape carrier package ("TCP") to be connected to the display panel 300. However, the data driver 700 may be connected to and/or disposed on the display panel 300 in other manners. For example, in an alternative exemplary embodiment, the data driver 700 is formed on the non-display area PA of the display panel 300.

The horizontal synchronization start signal generation circuit 720 generates a horizontal synchronization start signal RST using the image data signals DAT, and supplies the data driving circuit 750 with the same. When the image data signals DAT at high levels are applied during a predetermined period of time, the horizontal synchronization start signal generation circuit 720 senses the application of the high-level image data signals DAT, generates the horizontal synchronization start signal RST, and supplies the data driving circuit 750 with the generated horizontal synchronization start signal RST.

In an alternative embodiment of the present invention, the horizontal synchronization start signal generation circuit 720 is disabled in response to the load signal TP. For example, the horizontal synchronization start signal generation circuit 720 according to the alternative embodiment of the present invention does not generate a horizontal synchronization start signal RST while the data signals S1-Sm are supplied using the image data signal DAT sampled in the data driving circuit 750.

Accordingly, in a display device according to at least one exemplary embodiment of the present invention, the data driver 700 can be driven without being supplied with a horizontal synchronization start signal RST from the timing controller 500 through a separate line, thereby reducing the number of lines transmitting signals in the display device. Further, even if noise is generated due to the data control signal CONT2 in generating the horizontal synchronization start signal RST in the data driver 700, the horizontal synchronization start signal RST can be generated in a stable manner to be used for driving. The horizontal synchronization start signal generation circuit 720 according to exemplary embodiments of the present invention will later be described in detail with reference to FIGS. 4 through 8.

The data driving circuit 750 samples the image data signals DAT in response to the horizontal synchronization start signal RST, and generates the data signals S1-Sm using the sampled image data signal in response to the load signal TP. As shown in FIG. 3, the data driving circuit 750 includes a shift register 752, a digital-to-analog converter DAC 754, and a buffer 756.

The shift register 752 samples the image data signals DAT in response to the horizontal synchronization start signal RST. The shift register 752 sequentially samples the image data signals DAT in response to the horizontal synchronization start signal RST and the data sampling clock signal INTCLK. The operation of sampling the image data signals DAT in the shift register 752 may be initiated in response to a rising edge of, for example, the horizontal synchronization start signal RST.

Although not shown in FIG. 3, the data driver 700 may include a plurality of sub data drivers. For example, after a first sub data driver of the plurality samples all the image data signals, it may transmit a carry out signal to a next sub data driver.

When the image data signals DAT are all sampled in the shift register 752, the shift register 752 outputs the sampled image data signals DAT together in response to the load signal TP and supplies the DAC 754 with the sampled image data signals DAT. The operation of the shift register 752 outputting the sampled image data signals DAT may be performed in response to the rising edge of, for example, the load signal TP.

The DAC 754 receives the sampled image signals DAT from the shift register 752 and outputs analog data signals corresponding to the sampled image signals DAT. The DAC 754 may supply the buffer 756 with the analog data signals corresponding to the sampled image signals DAT using gamma voltages supplied from the gamma voltage generator 800. The operation of the DAC 754 outputting the analog data signals may be performed in response to a falling edge of, for example, the load signal TP.

The buffer 756 buffers the analog data signals supplied from the DAC 754 and outputs the data signals S1-Sm using the buffered analog data signals. The buffer 756 selects the polarities of the analog data signals from the DAC 754 in response to an inversion signal RVS or a polarity signal POL and applies the analog data signals having the selected polarities to the data lines D1-Dm of the display panel 300 as the data signals S1-Sm.

When a next frame starts after one frame finishes, a polarity signal POL or an inversion signal RVS applied to the data driver 700 may be controlled such that polarities of the analog data signals are reversed (which is referred to as 'frame inversion'). In alternative exemplary embodiments, the polarity signal POL or the inversion signal RVS may be controlled such that polarities of data signals flowing in a data line are periodically reversed during one frame (which is referred to as 'line inversion'), or polarities of data signals in a row of pixels are reversed (which is referred to as 'dot inversion').

Hereinafter, referring to FIGS. 4 through 6, a horizontal synchronization start signal generating circuit in a display device according to an exemplary embodiment of the present invention will be described.

Figure 4:
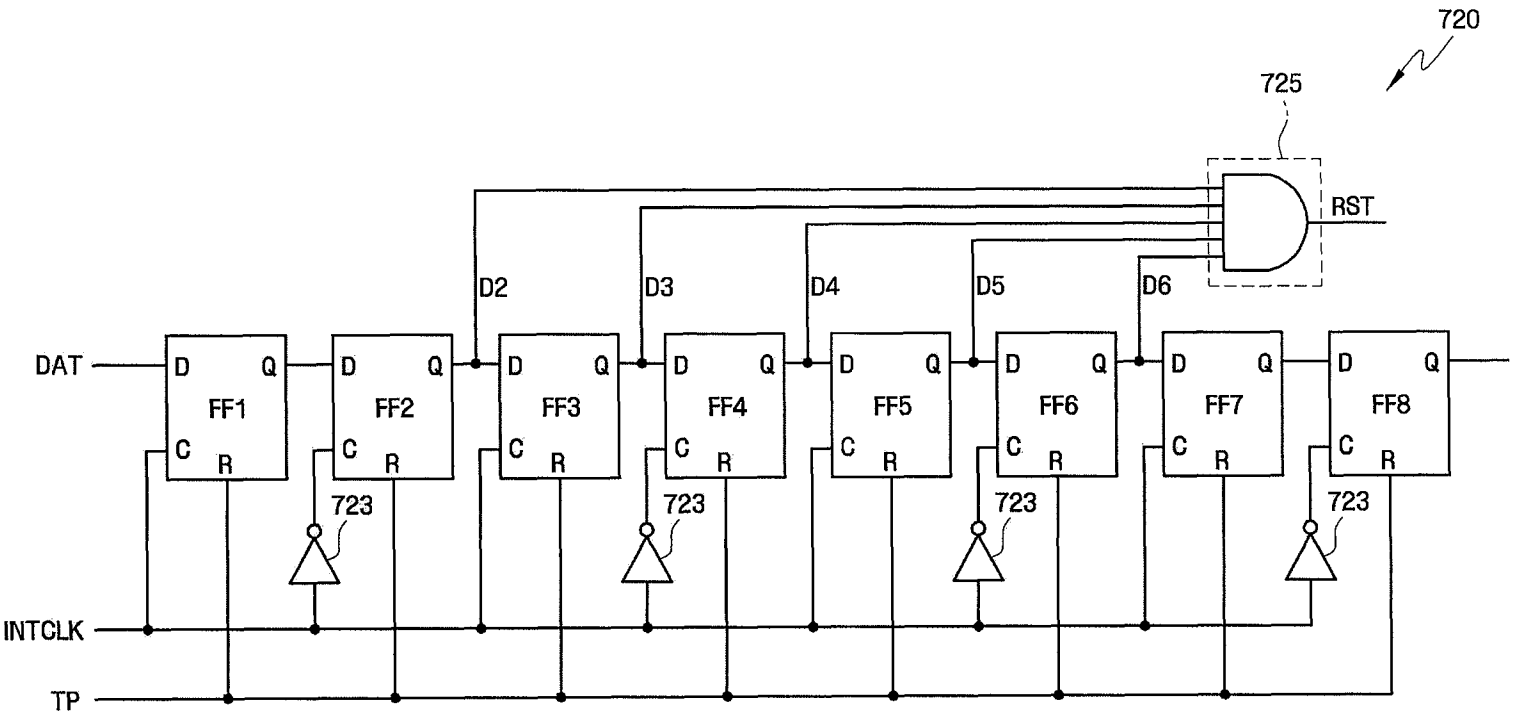
FIG. 4 is a circuit diagram showing a horizontal synchronization start signal generating circuit in a display device according to an exemplary embodiment of the present invention.

FIG. 4 is a circuit diagram showing a horizontal synchronization start signal generating circuit 720 in a display device according to an exemplary embodiment of the present invention. For brevity of explanation, FIG. 4 shows that the horizontal synchronization start signal generation circuit 720 includes 8 flip-flops by way of example. However, embodiments of the horizontal synchronization start signal generation circuit 720 are not limited to 8 flip-flops, as additional or fewer flips-flops may be used.

Referring to FIG. 4, the horizontal synchronization start signal generation circuit 720 includes a plurality of flip-flops FF1-FF8 and an operation unit 725 that performs operations on output signals supplied from at least two flip-flops, e.g., FF2-FF6, among the plurality of flip-flops FF1-FF8.

The plurality of flip-flops FF1-FF8 are connected to one another in a cascade manner, and the respective flip-flops FF1-FF8 sequentially output the image data signals DAT applied to the first flip-flop among the flip-flops FF1-FF8 in response to the data sampling clock signal INTCLK. Each of the plurality of flip-flops FF1-FF8 includes an input terminal D, an output terminal Q, a clock terminal C and a reset terminal R.

The image data signals DAT are input to the input terminal D of the first flip-flop FF1, and outputs of previous flip-flops FF1-FF7 are input to input terminals D of the flip-flops FF2-FF8 other than the first flip-flop FF1. The data sampling clock signal INTCLK or the data sampling clock signal INTCLK having passed through an inverter 723 is applied to the clock terminal C of each of the plurality of flip-flops FF1-FF8. The load signal TP is applied to the reset terminal R of each of the plurality of flip-flops FF1-FF8. In an alternative exemplary embodiment of the start signal generation circuit 720, the inverter 723 that inverts the data sampling clock signal INTCLK is omitted. Although the respective flip-flops FF1-FF8 shown in FIG. 4 are D flip flops, they are not limited thereto. For example, a variety of types of flip-flops can be used in alternate embodiments of the present invention.

The image data signals DAT applied to the plurality of flip-flops FF1-FF8 may be used to generate data signals applied to pixels for displaying particular colors. For example, when the timing controller 500 supplies the data driver 700 with first through third image data signals DAT_R, DAT_G, and DAT_B corresponding to data signals applied to first through third pixels PX_R, PX_G, and PX_B using the respective input image data signals DAT, the horizontal synchronization start signal generation circuit 720 can generate a horizontal synchronization start signal RST using the first image data signal DAT_R.

The operation unit 725 performs operations on output signals supplied from at least two flip-flops, e.g., FF2-FF6, among the plurality of flip-flops FF1-FF8, to generate the horizontal synchronization start signal RST. The operation unit 725 may be an AND operator that performs an AND operation on each output signal to generate the horizontal synchronization start signal RST. For example, when the image data signals DAT at high levels are applied during a predetermined period of time, the operation unit 725 may sense the application of the high-level image data signals DAT and generate the horizontal synchronization start signal RST.

Although FIG. 4 illustrates that output signals supplied from five flip-flops FF2-FF6 are input to the operation unit 725, the operation unit 725 is not limited to receiving outputs from five flip-flops. For example, output signals supplied from a variety of numbers of flip-flops can be input to the operation unit 725 in alternate embodiments of the present invention.

Hereinafter, the operation of a display device according to an exemplary embodiment of the present invention will be described with reference to FIGS. 3 through 6. FIGS. 5 and 6 illustrate an operation of the horizontal synchronization start signal generating circuit in the display device according to an exemplary embodiment of the present invention.

Figure 5:
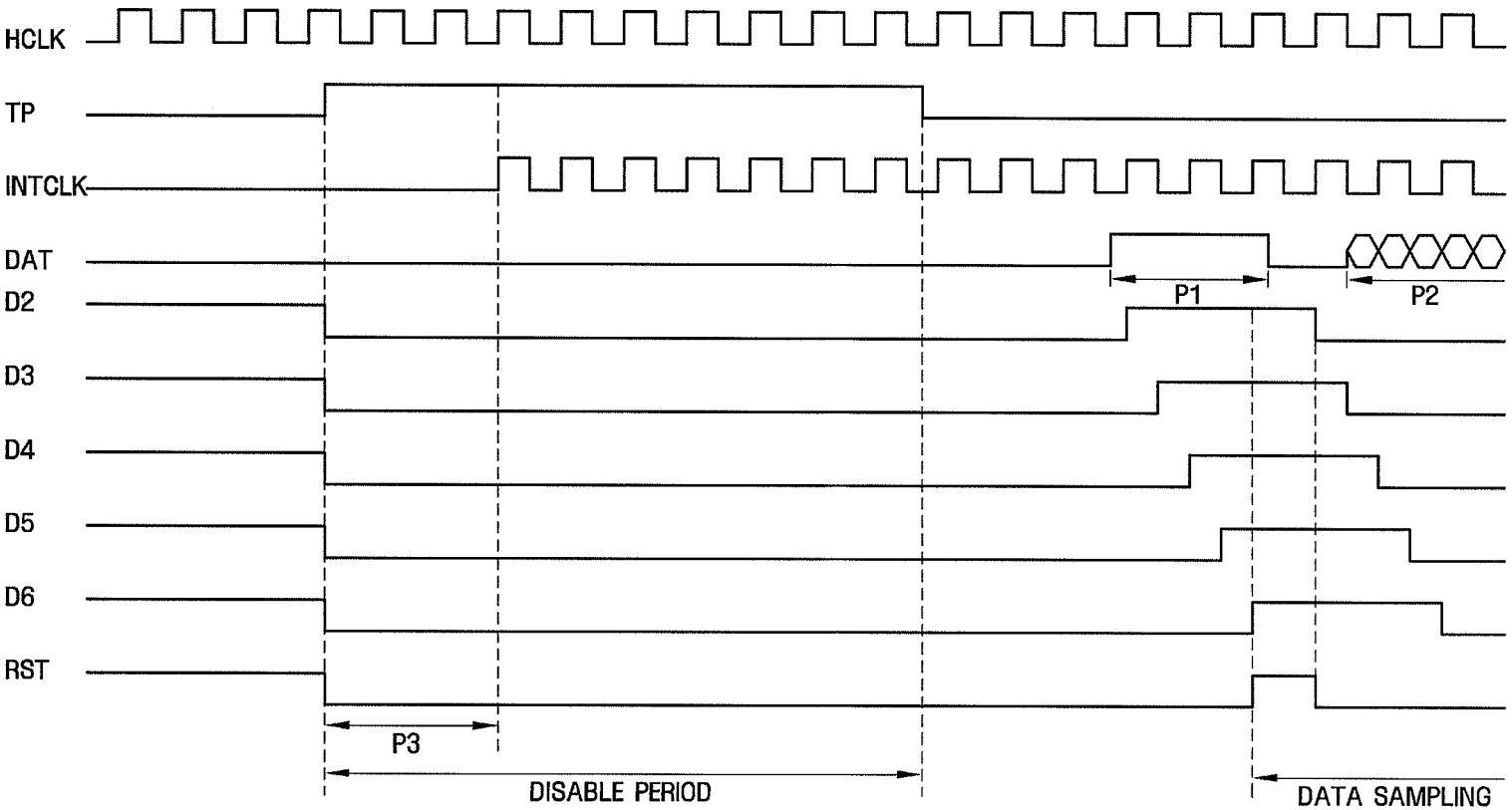
FIGS. 5 and 6 illustrate an operation of a horizontal synchronization start signal generating circuit in a display device according to an exemplary embodiment of the present invention.
Figure 6:
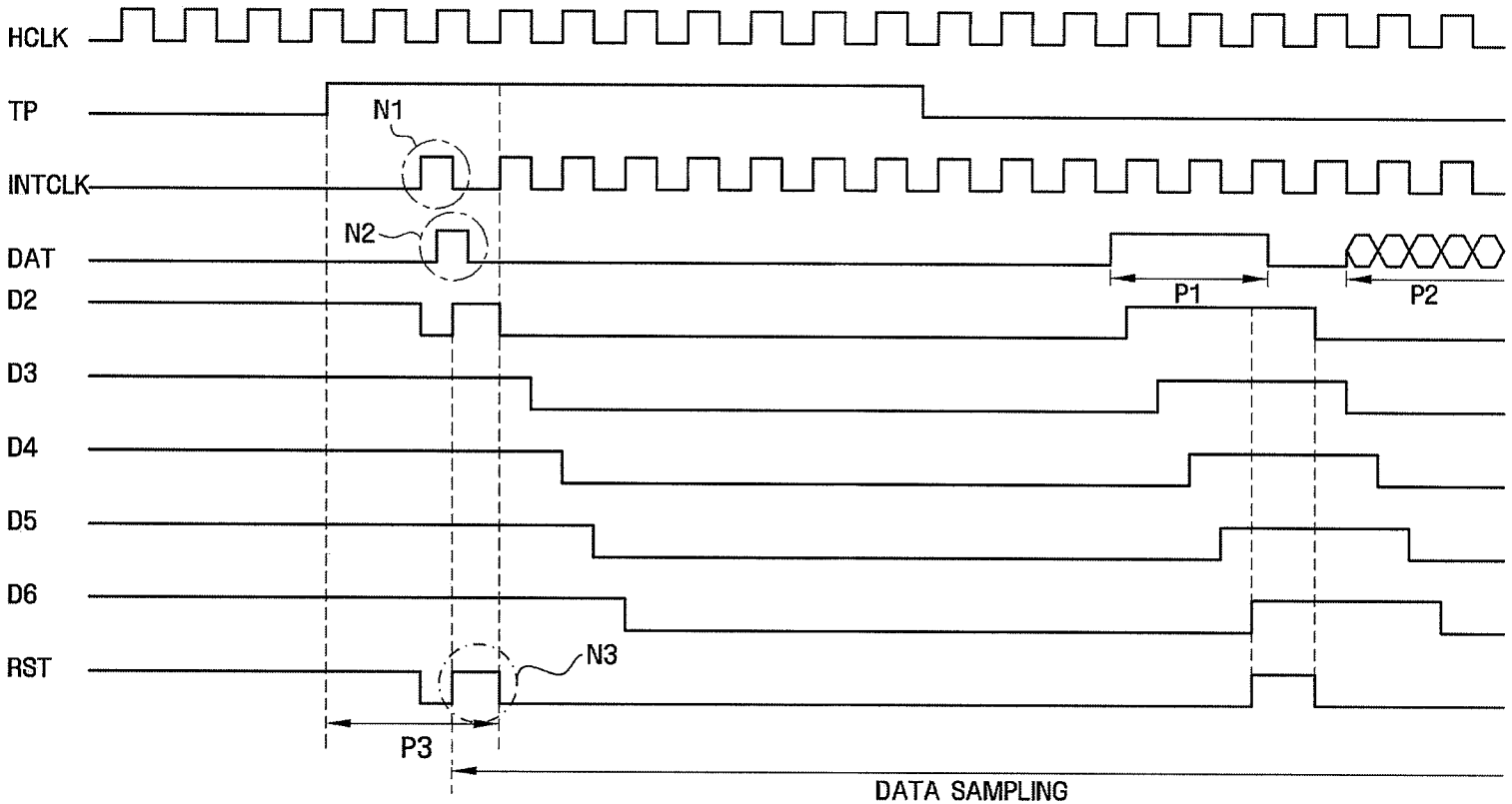

Referring to FIGS. 3 through 5, the data driver 700 generates the horizontal synchronization start signal RST using the image data signals DAT in a horizontal synchronization start signal generation period P1, and samples the image data signals DAT in an effective image data period P2 in response to the generated horizontal synchronization start signal RST. The effective image data period P2 includes effective image data signals DAT for generating the data signals S1-Sm, which are applied to the data lines D1-Dm. The respective data signals S1-Sm applied to the data lines D1-Dm can be generated using j bits of consecutive data lines D1-Dm in the effective image data period P2. The horizontal synchronization start signal generation period P1 includes k bits of image data signals DAT for inducing the horizontal synchronization start signal RST to be generated so that the effective image data signals DAT are sampled by the data driving circuit 750 before the effective image data signals DAT are applied.

To facilitate generation of the horizontal synchronization start signal RST with delay, the number of bits (e.g., k bits) of the image data signals DAT used to induce the generation of the horizontal synchronization start signal RST may be smaller than the number of bits (e.g., j bits) of the image data signals DAT used to generate the data signals S1-Sm. For example, the data driver 700 may generate the data signals S1-Sm using 8-bit image data signals DAT, and may generate the horizontal synchronization start signal RST using 5-bit image data signals DAT. However, the generation of the data signals S1-Sm and the horizontal synchronization start signal RST is not limited respectively to use of 8 and 5 bits of the image data signals DAT. For example, in an alternative exemplary embodiment, the number of bits (e.g., k bits) of the image data signals DAT used to induce the generation of the horizontal synchronization start signal RST may be equal to or greater than the number of bits (e.g., j bits) of the image data signals DAT used to generate the data signals S1-Sm. The values of j and k are natural numbers.

When the image data signals DAT at high levels are applied in the horizontal synchronization start signal generation period P1 during a predetermined period of time, the data driver 700 senses the application of the high-level image data signals DAT and generates the horizontal synchronization start signal RST. For example, when the k bits of the consecutive image data signals DAT are at high levels, the data driver 700 senses the high-level signals and generates the horizontal synchronization start signal RST.

The respective flip-flops FF1-FF8 of the horizontal synchronization start signal generation circuit 720 may sequentially output the image data signals DAT applied to the first flip-flop among the flip-flops FF1-FF8 in response to rising and falling edges of the data sampling clock signal INTCLK. Accordingly, output signals supplied from at least two flip-flops (e.g., FF2-FF6) among the plurality of flip-flops FF1-FF8 are input to the operation unit 725. The operation unit 725 performs AND operations on the output signals of the flip-flops FF2-FF6. When the output signals of the flip-flops FF2-FF6 connected to the operation unit 725 are all high level signals, the operation unit 725 supplies the data driving circuit 750 with the horizontal synchronization start signal RST.

The data driving circuit 750 of the data driver 700 samples the image data signals DAT in the effective data period P2 in response to the horizontal synchronization start signal RST. The shift register 752 may sequentially sample the image data signals DAT in response to the horizontal synchronization start signal RST and the data sampling clock signal INTCLK. The operation of the shift register 752 sampling the image data signals DAT may be initiated in response to a rising edge of, for example, the horizontal synchronization start signal RST.

However, when the horizontal synchronization start signal RST is generated in the data driver 700 using the image data signals DAT, the horizontal synchronization start signal generation circuit 720 may operate in an unstable manner due to noise caused by the data control signal CONT2, etc. For example, as shown in FIG. 6, the last several bits of the image data signals DAT are at high levels in the previous effective image data period P2, and an abnormal horizontal synchronization start signal N3 may be generated due to noise at a rising edge of the load signal TP. An abnormal data sampling clock signal N1 or an abnormal image data signal N2 may be generated due to noise in a period P3 after the load signal TP is applied and before the data sampling clock signal INTCLK is applied, thereby generating the abnormal horizontal synchronization start signal N3. Accordingly, the operation of the data driving circuit 750 sampling the image data signals DAT may be initiated at an unwanted time, thereby deteriorating display quality.

However, in the data driver 700 according to an exemplary embodiment of the present invention, the horizontal synchronization start signal generation circuit 720 is disabled in response to the load signal TP, so it can operate in a stable manner without generating the abnormal horizontal synchronization start signal N3.

Since the load signal TP is input to the reset terminal R of each of the flip-flops FF1-FF8, each of the flip-flops FF1-FF8 is reset while the high-level load signal TP is applied, and the horizontal synchronization start signal generation circuit 720 is disabled. Therefore, in the data driver 700 according to an exemplary embodiment of the present invention, even if the abnormal data sampling clock signal N1 or the abnormal image data signal N2 is generated due to noise in the period P3 after the load signal TP is applied and before the data sampling clock signal INTCLK is applied, the horizontal synchronization start signal generation circuit 720 can prevent the abnormal horizontal synchronization start signal N3 from being generated, thereby preventing the display quality from deteriorating.

Hereinafter, a horizontal synchronization start signal generation circuit in a display device according to another exemplary embodiment of the present invention will be described with reference to FIG. 3 and FIGS. 5 through 8.

Figure 7A:
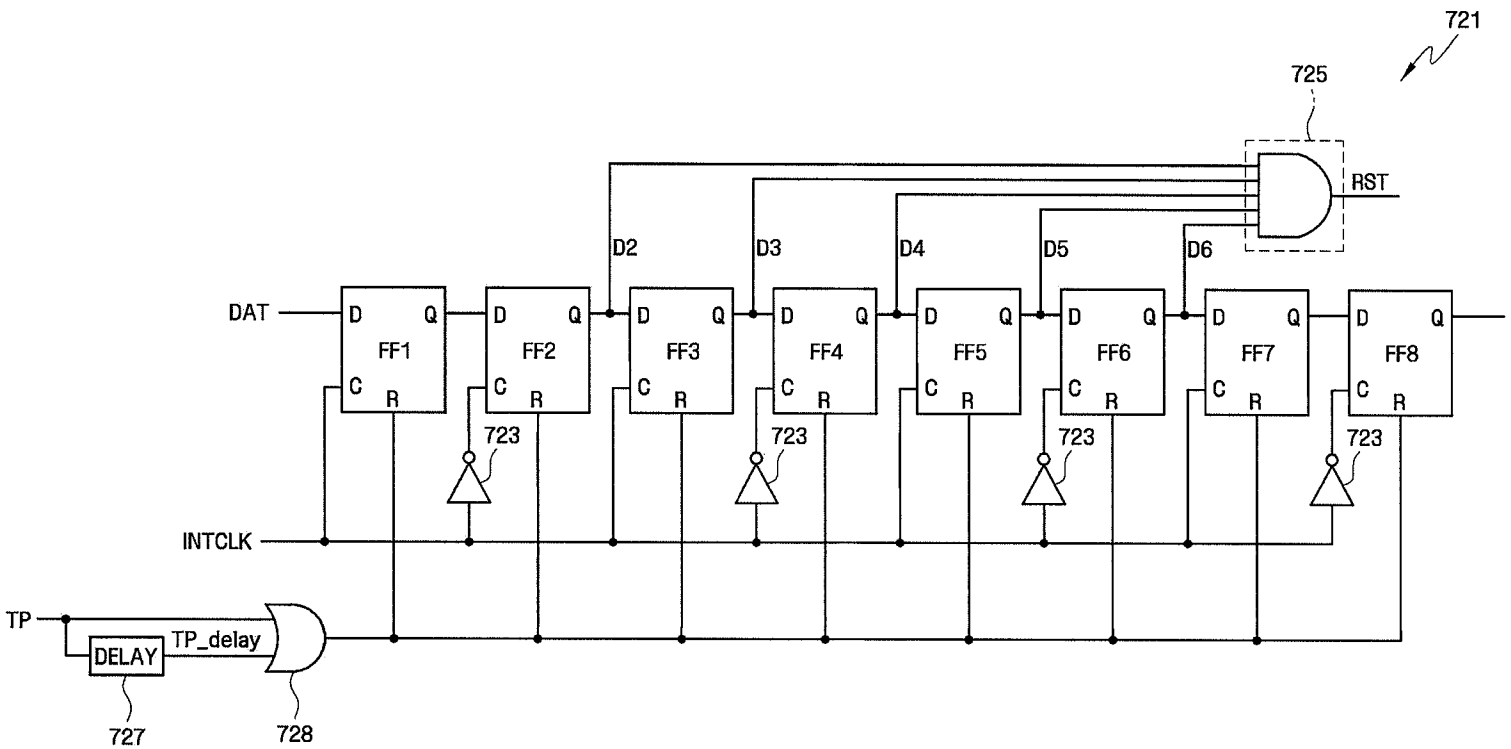
FIG. 7A is a circuit diagram showing a horizontal synchronization start signal generating circuit in a display device according to another exemplary embodiment of the present invention.
Figure 7B:
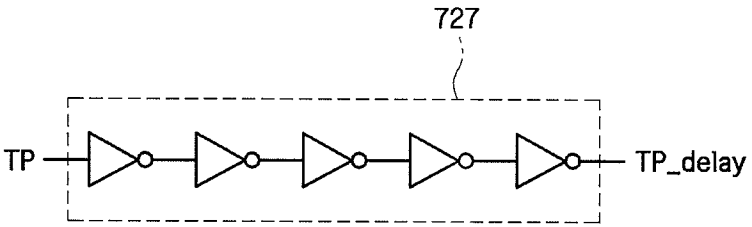
FIG. 7B is circuit diagram showing an embodiment of a delay unit shown in FIG. 7A.
Figure 8:
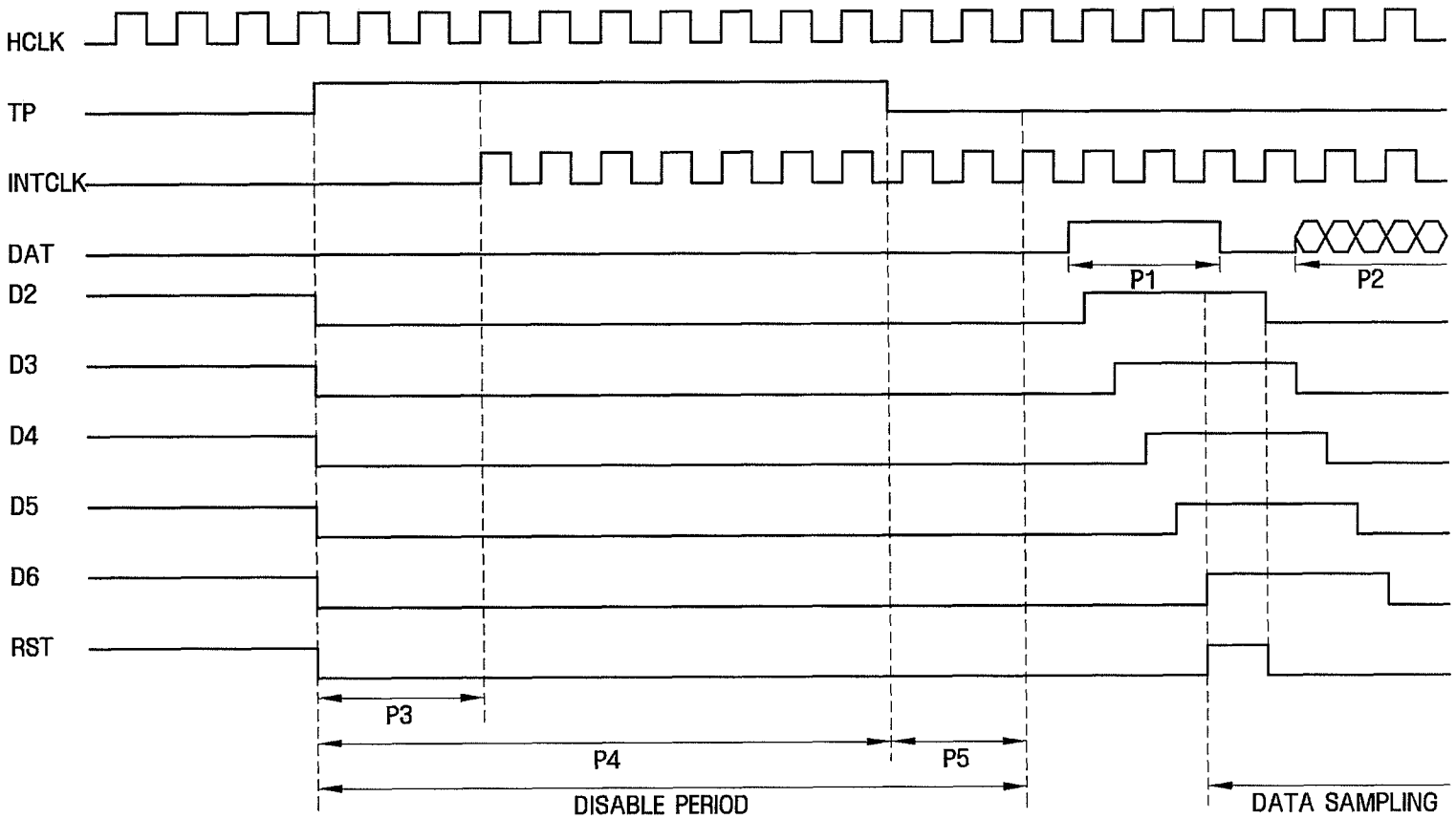
FIG. 8 illustrates an operation of a horizontal synchronization start signal generating circuit in a display device according to an exemplary embodiment of the present invention.

FIG. 7A is a circuit diagram showing a horizontal synchronization start signal generating circuit in a display device according to another exemplary embodiment of the present invention, FIG. 7B is an illustrated circuit diagram showing a delay unit shown in FIG. 7A, and FIG. 8 illustrates an operation of a horizontal synchronization start signal generating circuit in a display device according to an exemplary embodiment of the present invention.

Referring to FIGS. 7A through 8, the horizontal synchronization start signal generation circuit 721 differs from the horizontal synchronization start signal generation circuit 720 of FIG. 3 and FIG. 4 in that a load signal TP and a delayed signal TP_delay of the load signal TP are input to the reset terminal R of each of the flip-flops FF1-FF8.

In the horizontal synchronization start signal generation circuit 721, the load signal TP and the delayed signal TP_delay of the load signal TP are subjected to an OR operation by an OR operator 728 and input to the reset terminal R of each of the flip-flops FF1-FF8. As shown in FIG. 7B, a delay unit 727 may include a plurality of cascade-connected inverters. Although FIG. 7B shows that the delay unit 727 includes 5 inverters, the delay unit 727 is not limited any particular number of inverters. For example, a variety of numbers of inverters may be used according to the delayed extent of the load signal TP.

The horizontal synchronization start signal generation circuit 721 may be disabled in a period P5 in which the high-level load signal TP is delayed by the delay unit 727 as well as in a period P4 in which a high-level load signal TP is supplied.

For example, even when the load signal TP is not supplied, the horizontal synchronization start signal generation circuit 720 can be disabled by adjusting the period P5 in which the high-level load signal TP is delayed by the delay unit 727. Therefore, since the horizontal synchronization start signal generation circuit 720 can supply the horizontal synchronization start signal RST in a stable manner, the operation of the data driving circuit 750 sampling the image data signals DAT can be prevented from being initiated at an unwanted time, thereby effectively preventing deterioration of display quality of the display device.

While the present invention has been particularly shown and described with reference to exemplary embodiments thereof, it will be understood by those of ordinary skill in the art that various changes in form and details may be made therein without departing from the spirit and scope of the present disclosure.

What is claimed is:

1. A data driving apparatus comprising:

a horizontal synchronization start signal generation circuit that generates a horizontal synchronization start signal using image data signals; and a data driving circuit that samples the image data signals in response to the horizontal synchronization start signal and supplies a plurality of data signals using the sampled image data signals in response to a load signal, wherein the horizontal synchronization start signal generation circuit is disabled in response to the load signal, wherein the horizontal synchronization start signal generation circuit generates the horizontal synchronization start signal when at least two last bits of the image data signals are a same logic level, and wherein the horizontal synchronization start signal is derived from the at least two last bits.

2. The data driving apparatus of claim 1, wherein the image data signals have a horizontal synchronization start signal generation period and an effective image data period, the data driving circuit provides the respective data signals in the effective image data period using j bits of the image data signals, and the horizontal synchronization start signal generation circuit provides the horizontal synchronization start signal using k bits of the image data signals included in the horizontal synchronization start signal generation period, wherein j and k are natural numbers.

3. The data driving apparatus of claim 2, wherein the horizontal synchronization start signal generation circuit generates the horizontal synchronization start signal when the k bits of the image data signals included in the horizontal synchronization start signal generation period are all at high levels.

4. The data driving apparatus of claim 2, wherein k is less than j.

5. The data driving apparatus of claim 1, wherein the horizontal synchronization start signal generation circuit comprises:

a plurality of flip-flops that are connected to one another in a cascade manner, supplied with and sequentially outputting the image data signals; and an operation unit that performs an operation on output signals supplied from at least two flip-flops among the plurality of flip-flops.

6. The data driving apparatus of claim 5, wherein the load signal is input to a reset terminal of each of the plurality of flip-flops.

7. The data driving apparatus of claim 6, wherein the load signal or a delayed signal of the load signal is input to a reset terminal of each of the plurality of flip-flops.

8. The data driving apparatus of claim 5, wherein the operation unit performs AND operations on output signals supplied from at least two flip-flops among the plurality of flip-flops.

9. The data driving apparatus of claim 1, wherein the data driving circuit comprises:

a shift register that samples the image data signals in response to the horizontal synchronization start signal and a data sampling clock signal, and outputs the sampled image data signals in response to the load signal;

a digital-to-analog converter that receives the sampled image data signals from the shift register and outputs a plurality of analog data signals corresponding to the sampled data signals; and a buffer that is supplied with the plurality of analog data signals, selects polarities of the analog data signals and provides the selected polarities to the data signals.

10. A data driving apparatus comprising:

a horizontal synchronization start signal generation circuit that generates a horizontal synchronization start signal when at least two last bits of image data signals are a same logic level, the horizontal synchronization start signal being derived from the at least two last bits, the horizontal synchronization start signal generation circuit including a plurality of flip-flops that are connected to one another in a cascade manner, supplied with and sequentially outputting the image data signals, and an operation unit that performs a logical operation on output signals supplied from at least two flip-flops among the plurality of flip-flops to generate the horizontal synchronization start signal, wherein the logical operation indicates whether all of the output signals supplied from the at least two flip-flops to the operation unit have a same logic level;

a shift register that samples the image data signals in response to the horizontal synchronization start signal and a data sampling clock signal, and outputs the sampled image data signals in response to a load signal;

a digital-to-analog converter that receives the sampled image data signals from the shift register and outputs a plurality of analog data signals corresponding to the sampled data signals; and a buffer that is supplied with the plurality of analog data signals, selects polarities of the analog data signals and provides the selected polarities to the data signals, wherein the horizontal synchronization start signal generation circuit is disabled in response to the load signal.

11. The data driving apparatus of claim 10, wherein the load signal is input to a reset terminal of each of the plurality of flip-flops of the horizontal synchronization start signal generation circuit.

12. The data driving apparatus of claim 11, wherein the load signal or a delayed signal of the load signal is input to a reset terminal of each of the plurality of flip-flops of the horizontal synchronization start signal generation circuit.

13. The data driving apparatus of claim 10, wherein the image data signals have a horizontal synchronization start signal generation period and an effective image data period, the respective data signals are provided in the effective image data period using j bits of the image data signals, and the horizontal synchronization start signal generation circuit provides the horizontal synchronization start signal using k bits of the image data signals included in the horizontal synchronization start signal generation period, wherein j and k are natural numbers.

14. A display device comprising:

a display panel that includes a plurality of unit pixels at intersections of a plurality of gate lines and a plurality of data lines;

a timing controller that provides data control signals and image data signals; and a data driver that applies data signals to the plurality of data lines in response to the data control signals and the image data signal, the data driver comprising:

a horizontal synchronization start signal generation circuit that generates a horizontal synchronization start signal from an output of a logical operation performed on image data signals, wherein the horizontal synchronization start signal is generated when the logical operation indicates that at least two last bits of the image data signals are a same logic level, the horizontal synchronization start signal being an output of the logical operation; and a data driving circuit that samples the image data signals in response to the horizontal synchronization start signal and supplies a plurality of data signals using the sampled image data signals in response to a load signal, wherein the horizontal synchronization start signal generation circuit is disabled in response to the load signal.

15. The display device of claim 14, wherein the horizontal synchronization start signal generation circuit comprises:

a plurality of flip-flops that are connected to one another in a cascade manner, supplied with and sequentially outputting the image data signals; and an operation unit that performs the logical operation on output signals supplied from at least two flip-flops among the plurality of flip-flops, wherein the logical operation indicates whether all of the output signals supplied from the least two flip-flops to the operation unit are a same logic level;

wherein the data driving circuit comprises:

a shift register that samples the image data signals in response to the horizontal synchronization start signal and a data sampling clock signal, and outputs the sampled image data signals in response to a load signal;

a digital-to-analog converter that receives the sampled image data signals from the shift register and outputs a plurality of analog data signals corresponding to the sampled data signals; and a buffer that is supplied with the plurality of analog data signals, selects polarities of the analog data signals and provides the selected polarities to the data signals.

16. The display device of claim 15, wherein the load signal is input to a reset terminal of each of the plurality of flip-flops.

17. The display device of claim 16, wherein the load signal or a delayed signal of the load signal is input to a reset terminal of each of the plurality of flip-flops.

18. The display device of claim 15, wherein the operation unit performs AND operations on output signals supplied from at least two flip-flops among the plurality of flip-flops.

19. The display device of claim 14, wherein the image data signals have a horizontal synchronization start signal generation period and an effective image data period, the data driving circuit provides the respective data signals in the effective image data period using j bits of the image data signals, and the horizontal synchronization start signal generation circuit provides the horizontal synchronization start signal using k bits of the image data signals included in the horizontal synchronization start signal generation period, wherein j and k are natural numbers.

20. The display device of claim 19, wherein the horizontal synchronization start signal generation circuit generates the horizontal synchronization start signal when the k bits of the image data signals included in the horizontal synchronization start signal generation period are all at high levels.

* * * * *